US008201820B2

(12) United States Patent
Lu et al.

(10) Patent No.: US 8,201,820 B2
(45) Date of Patent: Jun. 19, 2012

(54) DOCUMENT FEEDING MECHANISM

(75) Inventors: Pei-Chun Lu, Taipei (TW); Yung-Kai Chen, Taipei (TW); Wen-Ching Liao, Taipei (TW)

(73) Assignee: Foxlink Image Technology Co., Ltd., Taipei (TW)

( * ) Notice: Subject to any disclaimer, the term of this patent is extended or adjusted under 35 U.S.C. 154(b) by 99 days.

(21) Appl. No.: 12/844,197

(22) Filed: Jul. 27, 2010

(65) Prior Publication Data

US 2012/0025444 A1 Feb. 2, 2012

(51) Int. Cl.
*B65H 3/06* (2006.01)

(52) U.S. Cl. ..... 271/117; 271/127; 271/160

(58) Field of Classification Search ..... 271/117, 271/118, 126, 127, 160, 115
See application file for complete search history.

(56) References Cited

U.S. PATENT DOCUMENTS 5,193,797 A * 3/1993 Harada et al. ..... 271/115
7,481,422 B2 * 1/2009 Lim ..... 271/118

* cited by examiner

*Primary Examiner* — Michael McCullough
(74) *Attorney, Agent, or Firm* — WPAT, P.C.; Anthony King

(57) ABSTRACT

A document feeding mechanism includes a driving shaft, a document blocking unit, a tray, an elastic unit and an actuating unit. The tray is pushed up to connect the document blocking unit by the elastic unit. The actuating unit is coupled to the driving shaft and abutted against the tray for pushing down the tray to separate from the document blocking unit. The actuating unit will be driven to allow the tray to be pushed to swing up by the elastic unit for blocking documents. The actuating unit will be driven to abut against the tray for pushing the tray to swing down for separating the tray from the document blocking unit for conveying the documents. Therefore, the document feeding mechanism has high reliability for blocking the documents.

9 Claims, 5 Drawing Sheets

DOCUMENT FEEDING MECHANISM

BACKGROUND OF THE INVENTION

1. Field of the Invention

The present invention relates to a document feeding mechanism, more specifically, to a document feeding mechanism with a floating input tray.

2. The Related Art

Please refer to FIG. 1 and FIG. 2. A conventional document feeding mechanism 900 includes a frame 902, a document picking up means 904, a driving means 906 and a pair of document blocking means 908. The document picking up means 904, the driving means 906 and the document blocking means 908 are configured to the frame 902.

The driving means 906 includes a motor 910 and a driving shaft 912. The driving shaft 912 interconnects the motor 910 and the document picking up means 904 for transmitting a driving force from the motor 910 to drive the document picking up means 904. The frame 902 includes a document supporting platform 914 formed at a front portion thereof for supporting documents and a pair of grooves 916 formed at a central portion thereof for receiving the document blocking means 908.

The frame 902 and the document picking up means 904 together define a document conveying path (not shown in figures) therebetween. The document picking up means 904 includes a supporting frame 918, a picking up unit 920, a separating unit 922, a transmitting unit 924 and a spring 926. The supporting frame 918 includes a pair of side walls 928, a tube 930 laterally protruded from a rear portion of one of the side walls 928 and a pair of blocks 932 laterally protruded from a front portion of the side walls 928.

The picking up unit 920 and the separating unit 922 are respectively coupled to the front portion and the rear portion of the supporting frame 918. The driving shaft 912 of the driving means 906 passes through the tube 930 of the supporting frame 918 and connects to the separating unit 922. The spring 926 is positioned in the tube 930 of the supporting frame 918 and surrounding the driving shaft 912 of the driving means 906.

Each of the document blocking means 908 includes a connection portion 934, a blocking arm 936 extended downwardly from the connection portion 934 and a pair of restricting arms 938 extended upward from the connection portion 934 respectively. The blocking arm 936 is extended into the groove 916 and drooped by gravity thereof for blocking the documents.

If the document feeding mechanism 900 works, then the picking up unit 920 of the document picking up means 904 will be raised at a predetermined level by the driving force from the driving means 906. The picking up unit 920 is held at the predetermined level because the spring 926 abuts against the tube 930 to form a friction therebetween.

The block 932 of the supporting frame 918 blocks the restricting arm 938 of the document blocking means 908 for restricting rotatable angle of the document blocking means 908. Since, the documents can be blocked outside the document conveying path by the document blocking means 908.

However, the restricting arm 938 of the document blocking means 908 may move beyond the block 932 of the supporting frame 918 if the blocking arm 936 of the document blocking means 908 is pushed exceedingly. Therefore, the document will intrude into the document conveying path to cause an erroneous work.

SUMMARY OF THE INVENTION

An object of the present invention is to provide a document feeding mechanism.

According to the invention, the document feeding mechanism includes a driving shaft, a document blocking means, a tray, an elastic means and an actuating means. The tray is pushed up to connect to the document blocking means by the elastic means. The actuating means is coupled to the driving shaft and abutted against the tray for pushing down the tray to separate from the document blocking means.

Another object of the present invention is to provide a document feeding mechanism.

According to the invention, the document feeding mechanism includes a frame, a driving shaft, a document picking up means, a document blocking means, a tray, a document conveying path, an elastic means and an actuating means. The driving shaft is coupled to the frame. The document picking up means is coupled to the driving shaft.

The tray is coupled to the frame. The document conveying path is defined between the document picking up means and the tray. The elastic means is positioned between the frame and the tray. The actuating means is coupled to the driving shaft. The elastic means pushes up the tray to connect the document blocking means for closing the document conveying path. The actuating means is selective to push down the tray to separate from the document blocking means for opening the document conveying path.

Another object of the present invention is to provide a document feeding mechanism.

According to the invention, the document feeding mechanism includes a frame, a driving shaft, a document picking up means, a document blocking means, a tray, a document conveying path, an elastic means and a pair of wheels. The driving shaft comprises opposite end portions respectively coupled to the frame. The document picking up means is coupled to a central portion of the driving shaft.

The document blocking means is coupled to the frame and positioned below the document picking up means. The tray is coupled to a front portion of the frame. The document conveying path is defined between the document picking up means and the tray. The elastic means is positioned between the frame and the tray. The wheels are respectively coupled to the driving shaft and positioned near the opposite end portions of the driving shaft. Each wheel comprises a pushing portion with a large radius and a releasing portion with a small radius.

The releasing portion of the actuating means is driven by the driving shaft to rotate to abut against the tray for allowing the tray to be pushed up by the elastic means to connect the document blocking means for closing the document conveying path and meanwhile the document picking up means is driven to swing up.

The pushing portion of the actuating means is driven by the driving shaft to rotate to abut against the tray for pushing down the tray for separating the tray from the document blocking means for closing the document conveying path and meanwhile the document picking up means is driven to swing down by the driving shaft.

Since, the releasing portion of the wheel of the actuating means will be driven to abut against the tray for allowing the rear portion of the tray to be pushed to swing up by the elastic means if the document feeding mechanism is idle. Since, the rear portion of the tray can swing up to connect the document blocking means for closing the document conveying path.

The pushing portion of the wheel of the actuating means will be driven to abut against the tray for pushing the rear portion of the tray to swing down if the document feeding mechanism works. Since, the rear portion of the tray can swing down to separate from the document blocking means for opening the document conveying path. Therefore, the document feeding mechanism has high reliability for blocking documents out of the document conveying path.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
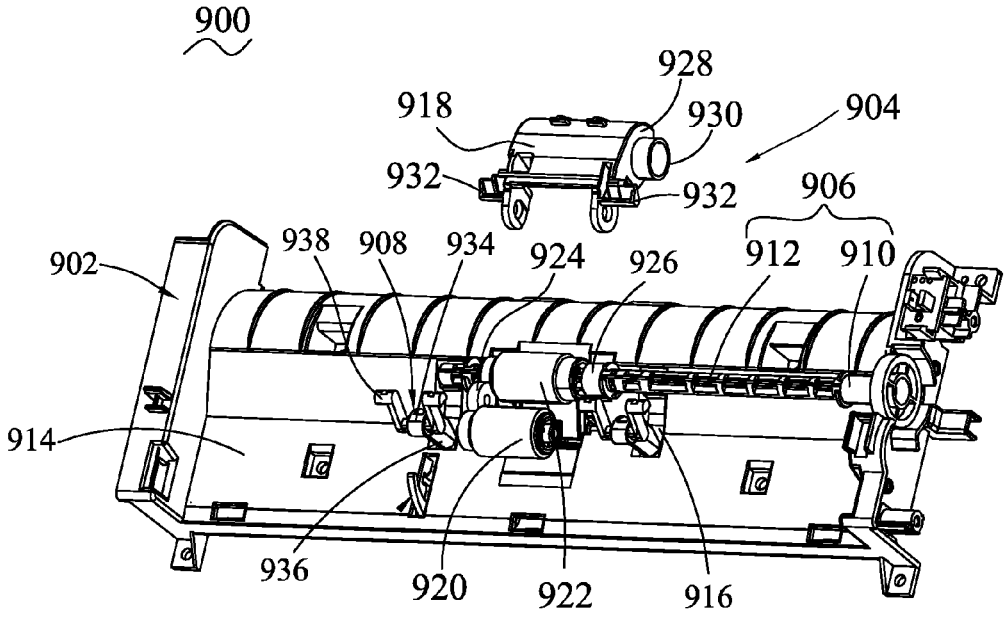
FIG. 1 (Prior Art)
FIG. 1 is a perspective view of a conventional document feeding mechanism.
Figure 2:
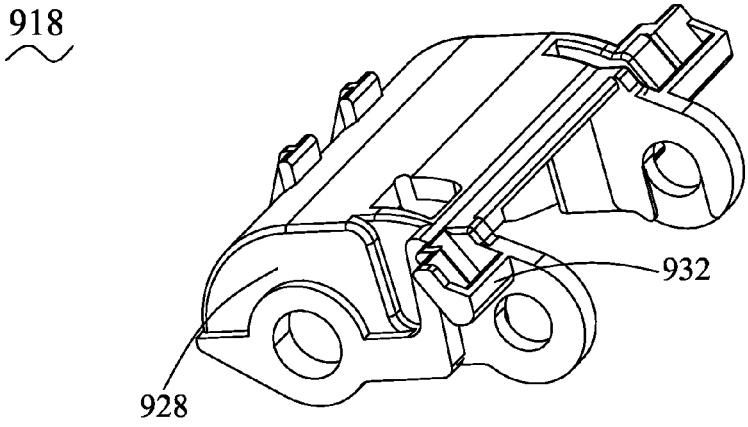
FIG. 2 (Prior Art)
FIG. 2 is a perspective view of a supporting frame of a document picking up means of the conventional document feeding mechanism.
Figure 3:
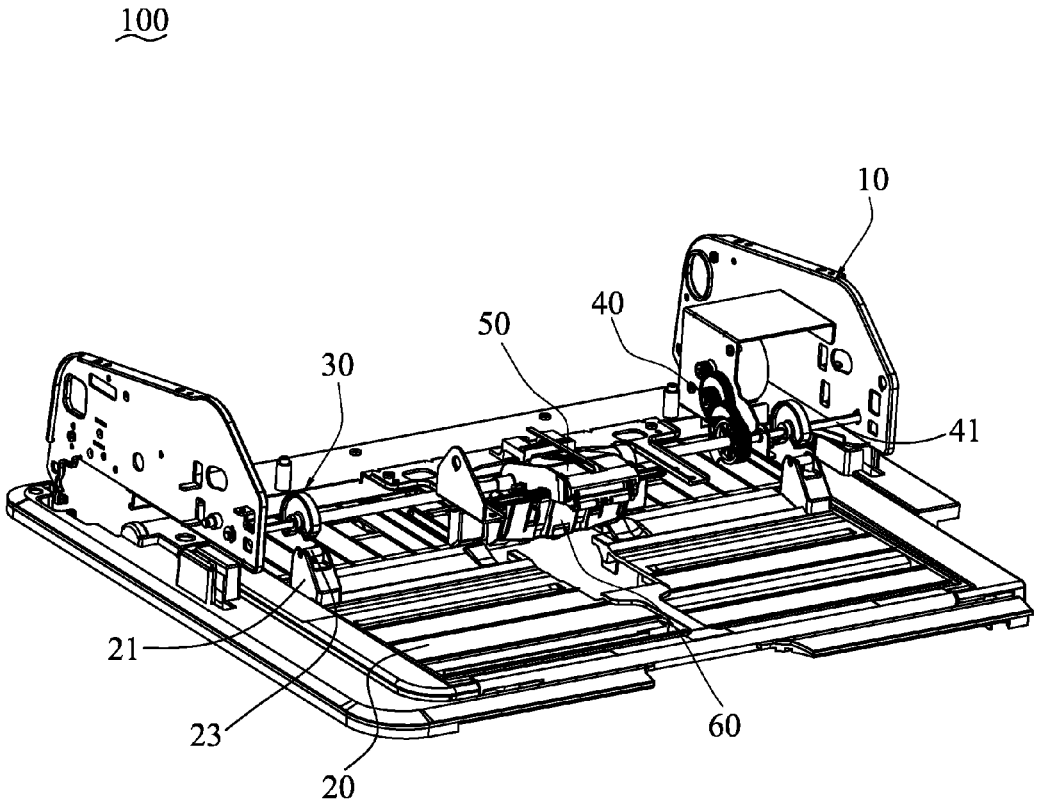
FIG. 3 is a perspective view of a preferred embodiment of a document feeding mechanism according to the present invention.
Figure 4:
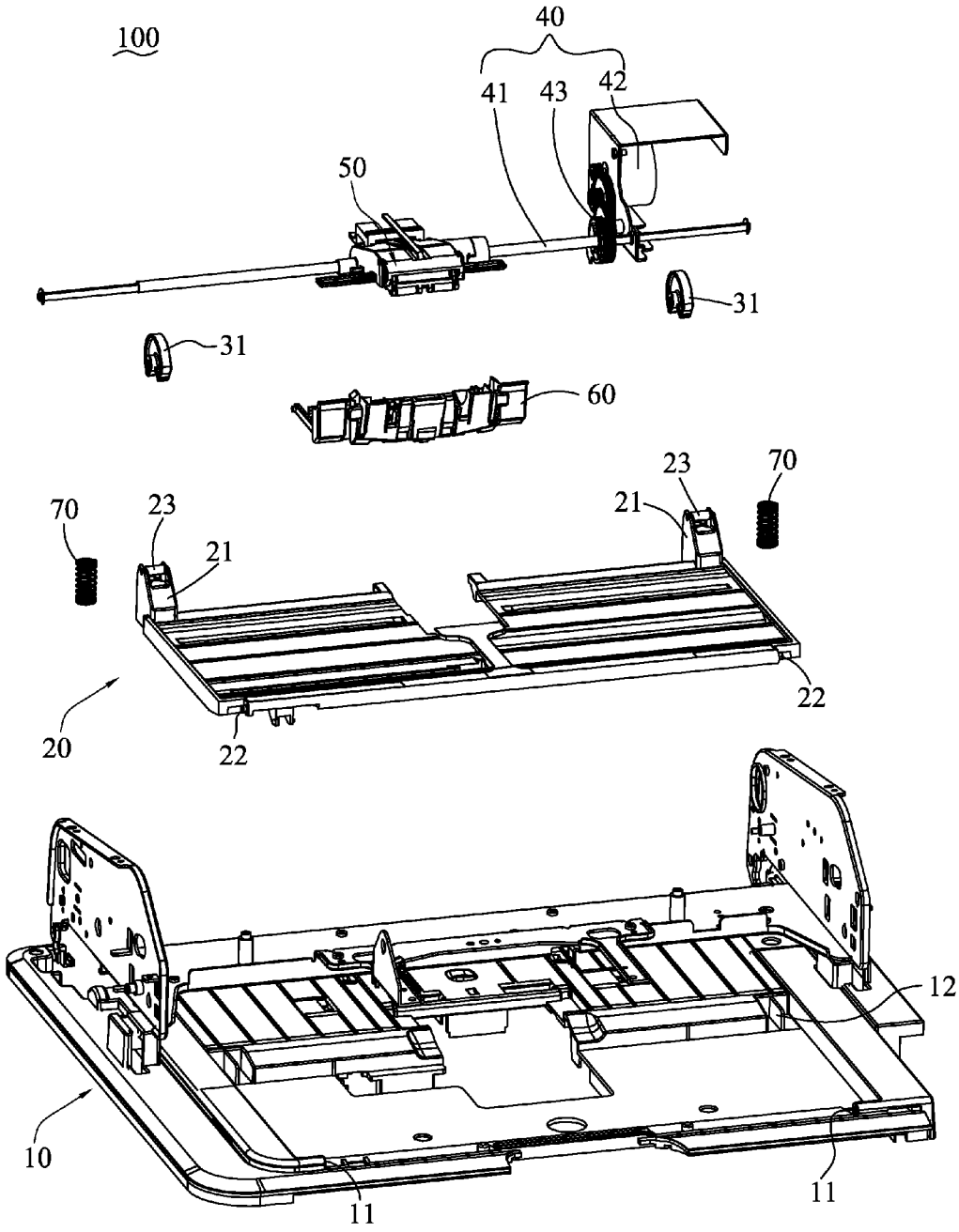
FIG. 4 is an exploded view of the document feeding mechanism according to the present invention.
Figure 5:
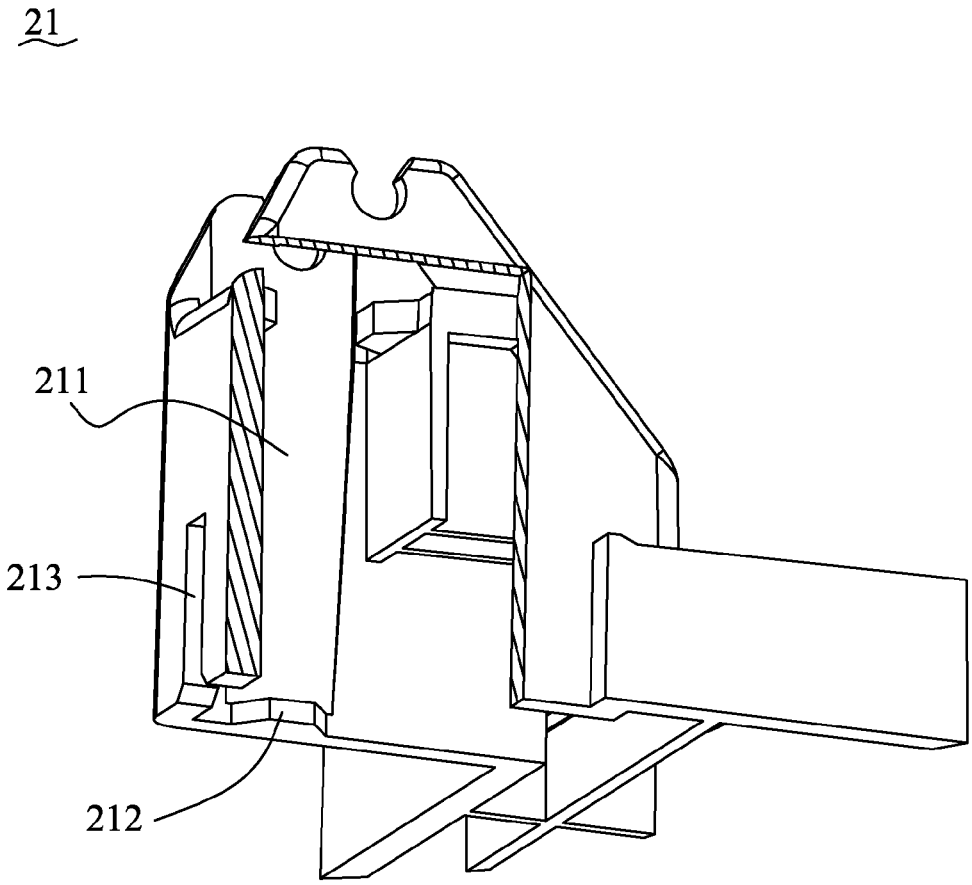
FIG. 5 is a cross section view showing a resisting pillar of a floating input tray of the document feeding mechanism according to the present invention.

Please refer to FIG. 3 to FIG. 7. A preferred embodiment of a document feeding mechanism 100 includes a frame 10, a floating input tray 20, an actuating means 30, a driving means 40, a document picking up means 50, a document blocking means 60 and a pair of springs 70. The floating input tray 20, the driving means 40, the document picking up means 50 and the document blocking means 60 respectively couple to the frame 10.

The frame 10 includes a pair of holes 11 formed at a front portion thereof and a pair of ribs 12 protruded upward at central portion thereof. The floating input tray 20 includes a pair of posts 22 protruded laterally from a front portion thereof, a pair of resisting pillars 21 protruded upwardly from a rear portion thereof and a pair of rollers 23 respectively coupled to a top portion of the resisting pillars 21.

The posts 22 of the floating input tray 20 respectively couple into the holes of the frame 10 for allowing the rear portion of the floating input tray 20 with the resisting pillars 21 to swing down and swing up. The springs 70 are respectively received in the resisting pillars 21. One end of each spring 70 abuts against the rib 12 of the frame 10 and the other end abuts against the resisting pillar 21 for pushing the resisting pillar 21 positioned at the rear portion of the floating input tray 20 upwardly. Especially, the spring 70 can be replaced by an elastic means.

Each of the resisting pillar 21 includes a receiving space 211 formed therein, a restricting piece 212 protruded into the receiving space 211 and a slot 213 formed at one side and along a longitudinal direction thereof. The slot 213 is connected to receiving space 211. The spring 70 is received in the receiving space 211 and retained in the receiving space by the restricting piece 212. The rib 12 of the frame 10 can slide into the receiving space 211 along the slot 213.

The driving means 40 includes a driving shaft 41, a motor 42 and a gear set 43 interconnected the motor 42 and the driving shaft 41. Opposite end portions of the driving shaft 41 respectively couple to the frame 10. The motor 42 drives the driving shaft to rotate clockwise and counterclockwise through the gear set 43.

The document picking up means 50 couples to a central portion of the driving shaft 41 of the driving means 40. The document picking up means 50 is driven for picking up and conveying documents by the driving means 40. The document blocking means 60 is coupled to the frame 10 and positioned below the document picking up means 50 for blocking the documents.

The actuating means 30 includes a pair of wheels 31 coupled to the driving shaft 41 of the driving means 40 and respectively positioned above the resisting pillars 21. Each of the wheels 31 includes a pushing portion 32 with a large radius and a releasing portion 33 with a small radius. The floating input tray 20 and the document picking up means 50 together define a document conveying path 80 therebetween. A distance between the pushing portion 32 and the driving shaft 41 is larger than a distance between the releasing portion 33 and the driving shaft 41.

Figure 6:
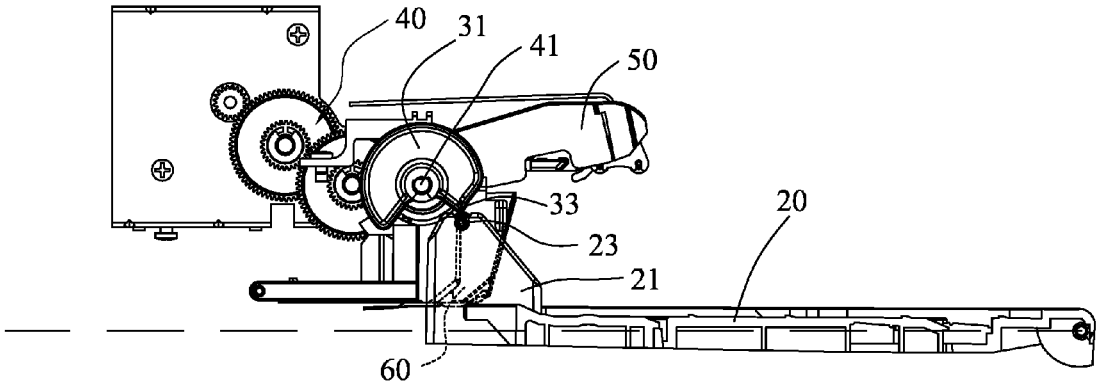
FIG. 6 is a lateral view showing the floating input tray swung up to abut against a document blocking means for blocking documents according to the present invention.

Please refer to FIG. 6. If the document feeding mechanism 100 is idle, then a front portion of the document picking up means 50 will be driven to swing up by the driving means 40. Meanwhile, the releasing portion 33 of the wheel 31 of the actuating means 30 is driven to rotate to connect the roller 23 positioned at the top of the resisting pillar 21 of the floating input tray 20.

The rear portion of the floating input tray 20 with the resisting pillar 21 is pushed to swing up by the spring 70. The roller 23 positioned on the top of the resisting pillar 21 of the floating input tray 20 abuts against the releasing portion 33 of the wheel 31 of the actuating means 30. Since, the rear portion of the floating input tray 20 can swing up to connect the document blocking means 60 for blocking the documents out of the document conveying path 80.

Figure 7:
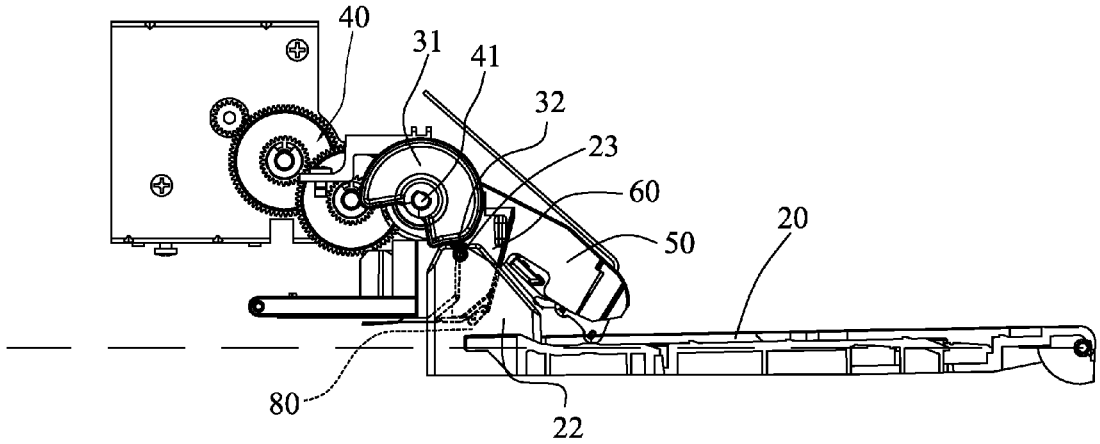
FIG. 7 is a lateral view showing the floating input tray swung down to separate from the document blocking means for conveying the documents according to the present invention.

Please refer to FIG. 7. If the document feeding mechanism 100 works, then a front portion of the document picking up means 50 is driven to swing down by the driving means 40. Meanwhile, the pushing portion 32 of the wheel 31 of the actuating means 30 is driven to rotate to connect the roller 23 positioned at the top of the resisting pillar 21 of the floating input tray 20.

Since, the rear portion of the floating input tray 20 is pushed to swing down. The rib 12 of the frame 10 is slid into the receiving space 211 of the resisting pillar 21 along the slot 213 to press the spring 70. The rear portion of the floating input tray 20 is separated from the document blocking means 60 for conveying the documents into document conveying path 80 by the document picking up means 50.

After the documents positioned on the floating input tray 20 are conveyed into the document conveying path 80, the document feeding mechanism 100 returns to the idle status. The rear portion of the floating input tray 20 will swing up to connect the document blocking means 60 for closing the document conveying path 80 again.

As described above, the releasing portion 33 of the wheel 31 of the actuating means 30 will be driven to connect the roller 23 of the resisting pillar 21 of the floating input tray 20 for allowing the rear portion of the floating input tray 20 with the resisting pillar 21 to be pushed to swing up by the spring 70 if the document feeding mechanism 100 is idle. Since, the rear portion of the floating input tray 20 can swing up to connect the document blocking means 60 for closing the document conveying path 80.

The pushing portion 32 of the wheel 31 of the actuating means 30 will be driven to connect the roller 23 of the resisting pillar 21 of the floating input tray 20 for pushing the rear portion of the floating input tray 20 with the resisting pillar 21 to swing down if the document feeding mechanism works. Since, the rear portion of the floating input tray 20 can swing down to separate from the document blocking means 60 for opening the document conveying path 80. Therefore, the document feeding mechanism 100 has high reliability for blocking the documents out of the document conveying path 80.

Furthermore, the present invention is not limited to the embodiments described above; diverse additions, alterations and the like may be made within the scope of the present invention by a person skilled in the art. For example, respective embodiments may be appropriately combined.

What is claimed is:

1. A document feeding mechanism comprising:

a driving shaft;

a document blocking means;

a tray being pushed up by an elastic means to connect to the document blocking means;

an actuating means coupled to the driving shaft and abutted against the tray for pushing down the tray to separate from the document blocking mean;

wherein the actuating means comprises a pushing portion with a large distance from the driving shaft being selected to abut against the tray for pushing down the tray to separate from the document blocking means;

a releasing portion with a small distance from the driving shaft for allowing the tray to be pushed up by the elastic means to connect to the document blocking means;

wherein the tray comprises a resisting pillar protruded upwardly to abut against the actuating means;

wherein a top portion of the resisting pillar is coupled with a roller to abut against the actuating means; and wherein the resisting pillar comprises a receiving space formed therein for receiving the elastic means.

2. The document feeding mechanism as claimed in claim 1, wherein the tray and the driving means are respectively coupled to a frame, the frame comprises a rib protruded upward therefrom and abutted against the elastic means.

3. The document feeding mechanism as claimed in claim 2, wherein the resisting pillar comprises a slot formed at one surface thereof and connected to the receiving space, the rib is slid into the receiving space along the slot for pressing the elastic means.

4. The document feeding mechanism as claimed in claim 3, wherein the resisting pillar comprises a restricting piece protruded into the receiving space for retaining the elastic means in the receiving space.

5. A document feeding mechanism comprising:

a frame;

a driving shaft coupled to the frame;

a document picking up means coupled to the driving shaft;

a document blocking means;

a tray coupled to the frame;

a document conveying path defined between the document picking up means and the tray;

an elastic means positioned between the frame and the tray; and an actuating means coupled to the driving shaft;

wherein the elastic means pushes up the tray to connect the document blocking means for closing the document conveying path, the actuating means is selective to push down the tray to separate from the document blocking means for opening the document conveying path;

wherein the actuating means comprises a pushing portion with a large distance from the driving shaft;

a releasing portion with a small distance from the driving shaft;

wherein the pushing portion is selected to abut against the tray for pushing down the tray, the releasing portion is selected to allow the tray to be pushed up by the elastic means;

wherein the pushing portion of the actuating means is driven to rotate to abut against the tray for pushing down the tray by the driving shaft and meanwhile the document picking up means is driven to swing down by the driving shaft, the releasing portion of the actuating means is driven to rotate to abut against the tray for allowing the tray to be pushed up by the elastic means and meanwhile the document picking up means is driven to swing up;

wherein the tray comprises a resisting pillar protruded upwardly to abut against the actuating means;

wherein a top portion of the resisting pillar is coupled with a roller to abut against the actuating means; and wherein the resisting pillar comprises a receiving space formed therein for receiving the elastic means.

6. The document feeding mechanism as claimed in claim 5, wherein the frame comprises a rib protruded upward therefrom and abutted against the elastic means.

7. The document feeding mechanism as claimed in claim 6, wherein the resisting pillar comprises a slot formed at one surface thereof and connected to the receiving space, the rib is slid into the receiving space along the slot for pressing the elastic means.

8. The document feeding mechanism as claimed in claim 7, wherein the resisting pillar comprises a restricting piece protruded into the receiving space for retaining the elastic means in the receiving space.

9. A document feeding mechanism comprising:

a frame;

a driving shaft comprising opposite end portions respectively coupled to the frame;

a document picking up means coupled to a central portion of the driving shaft;

a document blocking means coupled to the frame and positioned below the document picking up means;

a tray coupled to a front portion of the frame;

a document conveying path defined between the document picking up means and the tray;

an elastic means positioned between the frame and the tray; and a pair of wheels respectively coupled to the driving shaft and positioned near the opposite end portions, each wheel comprises a pushing portion with a large radius and a releasing portion with a small radius;

wherein the releasing portion of the wheels is driven by the driving shaft to rotate to abut against the tray for allowing the tray to be pushed up by the elastic means to connect the document blocking means for closing the document conveying path and meanwhile the document picking up means is driven to swing up;

wherein the pushing portion of the wheels is driven by the driving shaft to rotate to abut against the tray for pushing down the tray for separating the tray from the document blocking means for closing the document conveying path and meanwhile the document picking up means is driven to swing down by the driving shaft;

wherein the tray comprises a pair of resisting pillar protruded upwardly from a rear portion thereof to abut against the wheels respectively; and wherein a top portion of each resisting pillar is coupled with a roller to abut against the wheels, the resisting pillar comprises a receiving space formed therein for receiving the elastic means, a slot formed at one surface thereof and connected to the receiving space and a restricting piece protruded into the receiving space for retaining the elastic means in the receiving space, the frame comprises a pair of ribs respectively protruded upward and slid into the receiving space along the slot for abutting against the elastic means.

* * * * *